US008459368B2

(12) United States Patent
Sivrikoz et al.

(10) Patent No.: US 8,459,368 B2
(45) **Date of Patent: *Jun. 11, 2013**

(54) SYSTEMS AND METHODS FOR PRODUCING OIL AND/OR GAS

(75) Inventors: Ayca Sivrikoz, Houston, TX (US); William E. Hickman, Bellaire, TX (US)

(73) Assignee: Shell Oil Company, Houston, TX (US)

( * ) Notice: Subject to any disclaimer, the term of this patent is extended or adjusted under 35 U.S.C. 154(b) by 254 days.

This patent is subject to a terminal disclaimer.

(21) Appl. No.: 11/740,053

(22) Filed: Apr. 25, 2007

(65) Prior Publication Data

US 2007/0251686 A1 Nov. 1, 2007

Related U.S. Application Data

(60) Provisional application No. 60/745,808, filed on Apr. 27, 2006.

(51) Int. Cl.
*E21B 43/16* (2006.01)
*E21B 43/00* (2006.01)

(52) U.S. Cl.
USPC ..... 166/400; 166/403; 166/369

(58) Field of Classification Search
None
See application file for complete search history.

(56) References Cited

U.S. PATENT DOCUMENTS

| | | | | |
|---|---|---|---|---|
| 2,330,934 A | | 10/1943 | Thacker | 23/206 |
| 2,492,719 A | | 12/1949 | Thacker | 23/206 |
| 2,636,810 A | | 4/1953 | Marisic | 23/206 |
| 2,670,801 A | | 3/1954 | Sherborne | |
| 3,087,788 A | | 4/1963 | Porter | 23/181 |
| 3,345,135 A | | 10/1967 | Kerr et al. | 23/206 |
| 3,366,452 A | | 1/1968 | Wynne | 23/204 |
| 3,393,733 A | | 7/1968 | Kuo et al. | 166/8 |
| 3,402,768 A | | 9/1968 | Felsenthal et al. | |
| 3,480,081 A | * | 11/1969 | Felsenthal et al. | 166/272.3 |
| 3,498,378 A | | 3/1970 | Stone et al. | 166/263 |
| 3,581,821 A | | 6/1971 | Ross | 166/245 |
| 3,647,906 A | | 3/1972 | Farley | 260/683 D |
| 3,653,438 A | * | 4/1972 | Wagner | 166/266 |
| 3,672,448 A | | 6/1972 | Hoyt | 166/245 |
| 3,724,553 A | | 4/1973 | Snavely, Jr. et al. | 166/304 |
| 3,729,053 A | | 4/1973 | Froning | 166/304 |
| 3,754,598 A | | 8/1973 | Holloway, Jr. | 166/249 |
| 3,794,114 A | | 2/1974 | Brandon | 166/249 |
| 3,805,892 A | | 4/1974 | Haynes, Jr. | 166/245 |
| 3,822,748 A | | 7/1974 | Allen et al. | 166/269 |
| 3,823,777 A | | 7/1974 | Allen et al. | 166/266 |
| 3,840,073 A | | 10/1974 | Allen et al. | 166/274 |
| 3,847,221 A | | 11/1974 | Allen et al. | 166/274 |
| 3,850,245 A | | 11/1974 | Allen et al. | 166/274 |

(Continued)

FOREIGN PATENT DOCUMENTS

| | | |
|---|---|---|
| EP | 0581026 A1 | 2/1994 |
| GB | 1007674 | 10/1965 |

(Continued)

OTHER PUBLICATIONS

"heavy oil" Schlumberger Oilfield Glossary, retrieved Mar. 18, 2009 from http://www.glossary.oilfield.slb.com/search.cfm.*

*Primary Examiner* — Angela M DiTrani

(57) ABSTRACT

A system comprising a carbon disulfide formulation storage; a mechanism for releasing at least a portion of the carbon disulfide formulation into a formation; and a mechanism for creating a pulse in the carbon disulfide formulation in the formation.

18 Claims, 7 Drawing Sheets

U.S. PATENT DOCUMENTS

| | | | | | |
|---|---|---|---|---|---|
| 3,878,892 | A | * | 4/1975 | Allen et al. | 166/267 |
| 3,913,672 | A | * | 10/1975 | Allen et al. | 166/402 |
| 3,927,185 | A | | 12/1975 | Meadow et al. | 423/443 |
| 4,008,764 | A | * | 2/1977 | Allen | 166/266 |
| 4,057,613 | A | | 11/1977 | Meadow et al. | 423/443 |
| 4,122,156 | A | | 10/1978 | Kittrell et al. | 423/443 |
| 4,182,416 | A | | 1/1980 | Trantham et al. | 166/245 |
| 4,271,925 | A | * | 6/1981 | Burg | 181/120 |
| 4,305,463 | A | | 12/1981 | Zakiewicz | 106/245 |
| 4,393,937 | A | | 7/1983 | Dilgren et al. | 166/272 |
| 4,476,113 | A | | 10/1984 | Young et al. | 424/161 |
| 4,488,976 | A | | 12/1984 | Dilgren et al. | 252/8.55 D |
| 4,543,434 | A | | 9/1985 | Chang | 585/310 |
| 4,550,779 | A | * | 11/1985 | Zakiewicz | 166/248 |
| 4,612,988 | A | * | 9/1986 | Segalman | 166/248 |
| 4,742,498 | A | * | 5/1988 | Barron | 367/85 |
| 4,822,938 | A | | 4/1989 | Audeh et al. | 585/324 |
| 4,963,340 | A | | 10/1990 | Audeh et al. | 423/444 |
| 5,065,821 | A | | 11/1991 | Huang et al. | 166/245 |
| 5,076,358 | A | | 12/1991 | Kissel | 166/275 |
| 5,120,935 | A | | 6/1992 | Nenniger | 392/305 |
| 5,607,016 | A | | 3/1997 | Butler | 166/263 |
| 5,609,845 | A | | 3/1997 | Cimini et al. | 423/648.1 |
| 5,803,171 | A | | 9/1998 | McCaffery et al. | 166/245 |
| 5,826,656 | A | | 10/1998 | McGuire et al. | 166/305.1 |
| 6,136,282 | A | | 10/2000 | Fisher | 423/220 |
| 6,149,344 | A | | 11/2000 | Eaton | 405/128 |
| 6,241,019 | B1 | | 6/2001 | Davidson et al. | 166/249 |
| 6,405,797 | B2 | | 6/2002 | Davidson et al. | 166/249 |
| 6,497,855 | B1 | | 12/2002 | Wachs | 423/648.1 |
| 6,506,349 | B1 | | 1/2003 | Khanmamedov | 423/210 |
| 6,706,108 | B2 | | 3/2004 | Polston | 106/285 |
| 6,851,473 | B2 | * | 2/2005 | Davidson | 166/263 |
| 7,139,219 | B2 | * | 11/2006 | Kolle et al. | 367/85 |
| 7,426,959 | B2 | * | 9/2008 | Wang et al. | 166/52 |
| 2001/0008619 | A1 | | 7/2001 | Geus et al. | 423/230 |
| 2002/0134706 | A1 | | 9/2002 | Keller et al. | 208/250 |
| 2003/0047309 | A1 | | 3/2003 | Thomas et al. | 166/265 |
| 2003/0194366 | A1 | | 10/2003 | Srinivas et al. | 423/230 |
| 2004/0022721 | A1 | | 2/2004 | Watson et al. | 423/574.1 |
| 2004/0096381 | A1 | | 5/2004 | Watson et al. | 423/224 |
| 2004/0146288 | A1 | | 7/2004 | Vinegar et al. | 392/301 |
| 2004/0146450 | A1 | | 7/2004 | Stauffer | 423/443 |
| 2004/0159583 | A1 | | 8/2004 | Mesters et al. | 208/208 |
| 2004/0256097 | A1 | | 12/2004 | Byrd et al. | 166/90.1 |
| 2005/0189108 | A1 | | 9/2005 | Davidson | 166/249 |
| 2006/0254769 | A1 | | 11/2006 | Wang et al. | 166/266 |
| 2007/0251686 | A1 | | 11/2007 | Sivrikoz et al. | 166/249 |
| 2008/0023198 | A1 | | 1/2008 | Hsu | 166/268 |
| 2008/0087425 | A1 | | 4/2008 | Hsu et al. | 166/266 |

FOREIGN PATENT DOCUMENTS

| | | | |
|---|---|---|---|
| GB | 1173344 | | 12/1969 |
| GB | 2379685 | A | 3/2003 |
| WO | WO9850679 | | 11/1998 |
| WO | WO2007131976 | A1 | 11/2007 |
| WO | WO2007131977 | A1 | 11/2007 |
| WO | WO2008003732 | A1 | 1/2008 |
| WO | WO2008034777 | A1 | 3/2008 |

* cited by examiner

SYSTEMS AND METHODS FOR PRODUCING OIL AND/OR GAS

RELATED APPLICATIONS

This application claims priority to U.S. Provisional Application 60/745,808, filed on Apr. 27, 2006. U.S. Provisional Application 60/745,808 is herein incorporated by reference in its entirety.

FIELD OF THE INVENTION

The present disclosure relates to systems and methods for producing oil and/or gas.

BACKGROUND OF THE INVENTION

Enhanced Oil Recovery (EOR) may be used to increase oil recovery in fields worldwide. There are three main types of EOR, thermal, chemical/polymer and gas injection, which may be used to increase oil recovery from a reservoir, beyond what can be achieved by conventional means—possibly extending the life of a field and boosting the oil recovery factor.

Thermal enhanced recovery works by adding heat to the reservoir. The most widely practiced form is a steam-drive, which reduces oil viscosity so that it can flow to the producing wells. Chemical flooding increases recovery by reducing the capillary forces that trap residual oil. Polymer flooding improves the sweep efficiency of injected water. Miscible gas injection works in a similar way to chemical flooding. By injecting a fluid that is miscible with the oil, trapped residual oil can be recovered.

Oil is often withdrawn from a reservoir in a non-uniform manner. That is, most of the oil is produced from the more easily drainable sections of the formation, and relatively little oil comes from the less easily drainable sections. This is especially true in highly fractured reservoirs or those having sections of widely varying permeability wherein oil is left in the less accessible portions of the reservoir. In such reservoirs an ordinary secondary recovery flooding treatment is often of limited value, as the injected fluid tends to sweep or pass through the same sections of the formation which are susceptible to good drainage, thus either bypassing or entering to only a limited extent those sections of the formation which cannot be readily drained.

Referring to FIG. 1, there is illustrated prior art system 100. System 100 includes underground formation 102, underground formation 104, underground formation 106, and underground formation 108. Production facility 110 is provided at the surface. Well 112 traverses formations 102 and 104, and terminates in formation 106. The portion of formation 106 is shown at 114. Oil and gas are produced from formation 106 through well 112, to production facility 110. Gas and liquid are separated from each other, gas is stored in gas storage 116 and liquid is stored in liquid storage 118. Gas in gas storage 116 may contain hydrogen sulfide, which must be processed, transported, disposed of, or stored.

U.S. Pat. No. 6,241,019 discloses extracting a liquid (such as oil) from a porous medium, where the liquid is subjected to pulses that propagate through the liquid flowing through the pores of the medium. The pulses cause momentary surges in the velocity of the liquid, which keeps the pores open. The pulses can be generated in the production well, or in a separate excitation well. If the pulses travel with the liquid, the velocity of travel of the liquid through the pores can be increased. The solid matrix is kept stationary, and the pulses move through the liquid. The pulses in the liquid can be generated directly in the liquid, or indirectly in the liquid via a localised area of the solid matrix. U.S. Pat. No. 6,241,019 is herein incorporated by reference in its entirety.

Co-pending U.S. Patent Application Publication No. 2006/0254769, published Nov. 16, 2006, discloses a system including a mechanism for recovering oil and/or gas from an underground formation, the oil and/or gas comprising one or more sulfur compounds; a mechanism for converting at least a portion of the sulfur compounds from the recovered oil and/or gas into a carbon disulfide formulation; and a mechanism for releasing at least a portion of the carbon disulfide formulation into a formation. U.S. Patent Application Publication No. 2006/0254769 is herein incorporated by reference in its entirety.

There is a need in the art for improved systems and methods for enhanced oil recovery. There is a need in the art for improved systems and methods for enhanced oil recovery with pressure pulsing. There is a need in the art for improved systems and methods for enhanced oil recovery with reduced fingering and/or with a more uniform front.

SUMMARY OF THE INVENTION

In one aspect, the invention provides a system comprising a carbon disulfide formulation storage; a mechanism for releasing at least a portion of the carbon disulfide formulation into a formation; and a mechanism for creating a pulse in the carbon disulfide formulation in the formation.

In another aspect, the invention provides a method comprising releasing a carbon disulfide formulation into a formation; and creating a pulse in the carbon disulfide formulation in the formation.

Advantages of the invention include one or more of the following:

Improved systems and methods for enhanced recovery of hydrocarbons from a formation with a carbon disulfide formulation.

Improved systems and methods for enhanced recovery of hydrocarbons from a formation with a fluid containing a carbon disulfide formulation.

Improved systems and methods for enhanced oil recovery.

Improved systems and methods for enhanced oil recovery with pressure pulsing.

Improved systems and methods for enhanced oil recovery with reduced fingering and/or with a more uniform front Improved systems and methods for enhanced oil recovery using a sulfur compound.

Improved systems and methods for enhanced oil recovery using a compound which is miscible with oil in place.

Improved systems and methods for making and/or using sulfur containing enhanced oil recovery agents.

DETAILED DESCRIPTION OF THE INVENTION

Figure 1:
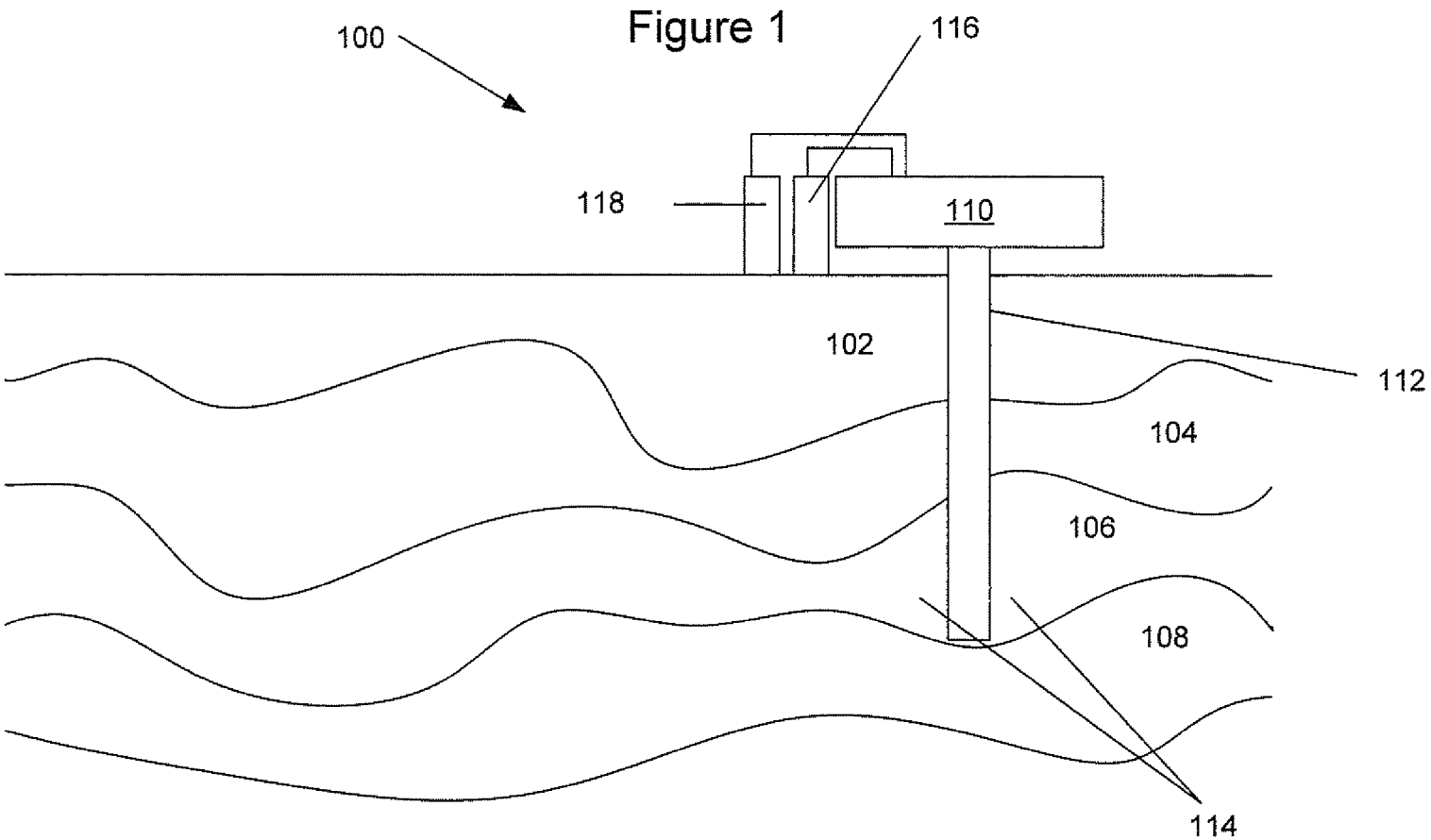
Figure 1 Prior Art
FIG. 1 illustrates an oil and/or gas production system.

Most oil bearing reservoirs or formations contain at least some sections which tend to retain oil more tightly than other sections. For example, the formation may contain many natural or induced fractures, interconnected vugs, solution channels, hetergeneous lenses or networks of large pore size material dissecting smaller pore size, or is otherwise nonhomogeneous. The area in the immediate vicinity of these fractures or other discontinuities may drain more easily than areas more remote from the fractures. Also, sections with a higher permeability and/or porosity may drain better than those with a lower permeability and/or porosity. This invention may be applied to any such formation which contains sections from which oil can be removed at a reduced level by primary recovery techniques.

Although there is nothing to preclude the use of this invention on newly drilled or previously unproduced reservoirs, it may also be applied in treating partially depleted reservoirs, e.g., those from which some oil has been produced and/or the reservoir pressure has declined.

A porous medium is a natural or man-made material comprising a solid matrix and an interconnected pore (or fracture) system within the matrix. The pores may be open to each other and can contain a fluid, and fluid pressure can be transmitted and fluid flow can take place through the pores. Examples of porous materials include gravels, sands and clays; sandstones, limestones and other sedimentary rocks; and fractured rocks including fractured sedimentary rocks which have both fractures and/or pores through which fluids may flow.

The porosity of a porous medium is the ratio of the volume of open space in the pores to the total volume of the medium. Systems may have porosities from about 5% to about 60%.

The porosity (pores, fractures, and channels) may be filled with fluids, which may be gases or liquids or a combination of the two.

Porous media may be characterized by a permeability. Permeability is an average measure of the geometry of the pores, pore throats, and other properties which describes the flow rate of fluids through the medium under the effect of a pressure gradient or a gravity force.

Pressure pulsing is a deliberate variation of the fluid pressure in the porous medium through the injection of fluid, withdrawal of fluid, or a combination of alternating periods of injection and withdrawal. The pressure pulsing may be regular or irregular (periodic or aperiodic), continuous or episodic, and may be applied at the point of injection, withdrawal, or at other points in the region of the porous medium affected by the flow process.

Dilational and shear pulses are the two basic types of excitation. In a dilational pulse, the perturbation is isotropic (equal in all directions) at the point of application, and may be termed a volumetric pulse. The dilational perturbation moves out in all directions approximately equally and is subject to scattering phenomena. In a shear pulse, a relative lateral excitation is applied so that the energy imparted to the porous medium is dominated by shear motion, such as occurs when slip occurs along a plane. Shear perturbation is highly anisotropic, and the distribution of energy depends on the orientation of the perturbing source. Shear perturbations can therefore in principle be focused so that more energy propagates in one direction than in another.

Flow takes place in a porous medium through generating a pressure gradient in the mobile (moveable) phases by creating spatial differences in fluid pressures. Reducing or increasing the pressure at a number of points may generate flow by the withdrawal or injection of fluids. Flow may also be generated through the force of gravity acting upon fluids of different density, such as oil, formation water, gas or air, injected non-aqueous phase liquids and other fluids. In a system where the solid particles are partly free to move, density differences between solids and fluids may also lead to gravity-induced flow.

Figure 2:
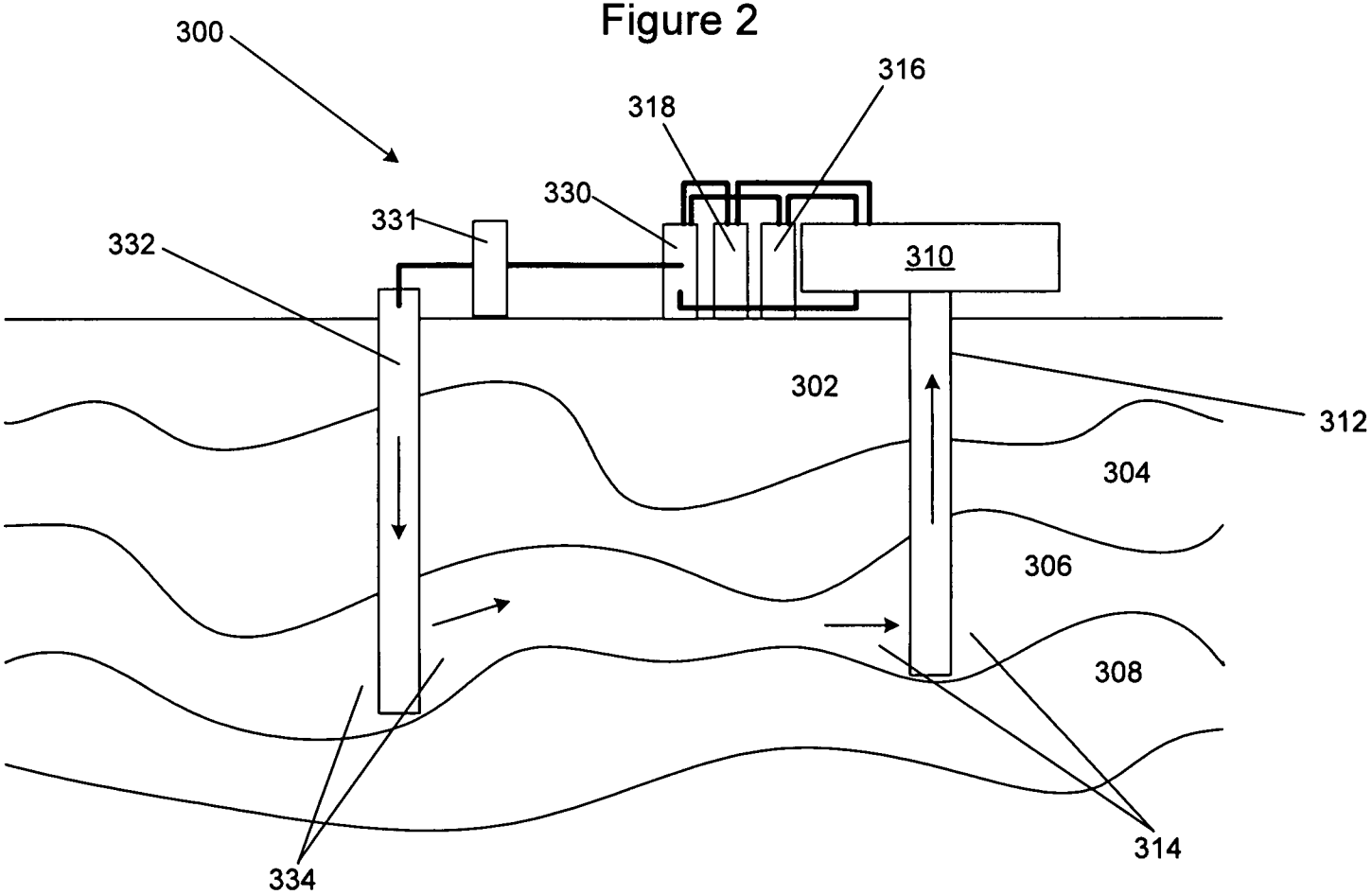
FIG. 2 illustrates an oil and/or gas production system.

Referring now to FIG. 2, in one embodiment of the invention, system 300 is illustrated. System 300 includes formation 302, formation 304, formation 306, and formation 308. Production facility 310 is provided at the surface. Well 312 traverses formation 302 and 304 has openings at formation 306. Portions of formation 314 may be optionally fractured and/or perforated. As oil and gas is produced from formation 306 it enters portions 314, and travels up well 312 to production facility 310. Gases and liquids may be separated, and gases may be sent to gas storage 316, and liquids may be sent to liquid storage 318. Production facility 310 may be able to produce carbon disulfide formulation, which may be produced and stored in carbon disulfide formulation storage 330. Carbon disulfide formulation may also be trucked, piped, or otherwise transported to carbon disulfide formulation storage 330. Hydrogen sulfide and/or other sulfur containing compounds from well 312 may be sent to carbon disulfide formulation production 330. Carbon disulfide formulation is pumped through pulsing mechanism 331 down well 332, to portions 334 of formation 306. Carbon disulfide formulation traverses formation 306 to aid in the production of oil and gas, and then the carbon disulfide formulation, oil and/or gas may all be produced to well 312, to production facility 310. Carbon disulfide formulation may then be recycled, for example by boiling the carbon disulfide formulation, condensing it or filtering or reacting it, then re-injecting the carbon disulfide formulation into well 332.

In some embodiments of the invention, the carbon disulfide formulation may include carbon disulfide and/or carbon disulfide derivatives for example, thiocarbonates, xanthates and mixtures thereof; and optionally one or more of the following: hydrogen sulfide, sulfur, carbon dioxide, hydrocarbons, and mixtures thereof.

In some embodiments, carbon disulfide formulation or carbon disulfide formulation mixed with other components may be miscible in oil and/or gas in formation 306. In some embodiments, carbon disulfide formulation or carbon disulfide formulation mixed with other components may be mixed in with oil and/or gas in formation 306 to form a miscible mixture which is produced to well 312.

In some embodiments, carbon disulfide formulation or carbon disulfide formulation mixed with other components may be immiscible in oil and/or gas in formation 306. In some embodiments, carbon disulfide formulation or carbon disulfide formulation mixed with other components may not mix in with oil and/or gas in formation 306, so that carbon disulfide formulation or carbon disulfide formulation mixed with other components travels as a plug across formation 306 to force oil and/or gas to well 312.

In some embodiments, a quantity of carbon disulfide formulation or carbon disulfide formulation mixed with other components may be injected into well 332, followed by another component to force carbon disulfide formulation or carbon disulfide formulation mixed with other components across formation 306, for example natural gas; carbon dioxide; air; water in gas or liquid form; water mixed with one or more salts, polymers, and/or surfactants; other gases; other liquids; and/or mixtures thereof.

In some embodiments, pulsing mechanism 331 is provided at the surface. In some embodiments, pulsing mechanism 331 may be provided within well 332, for example adjacent formation 306.

In some embodiments, pulsing mechanism 331 is a piston pump, which produces a pulse when in the forward stroke, and does not produce a pulse when in the reverse stroke.

Figure 3:
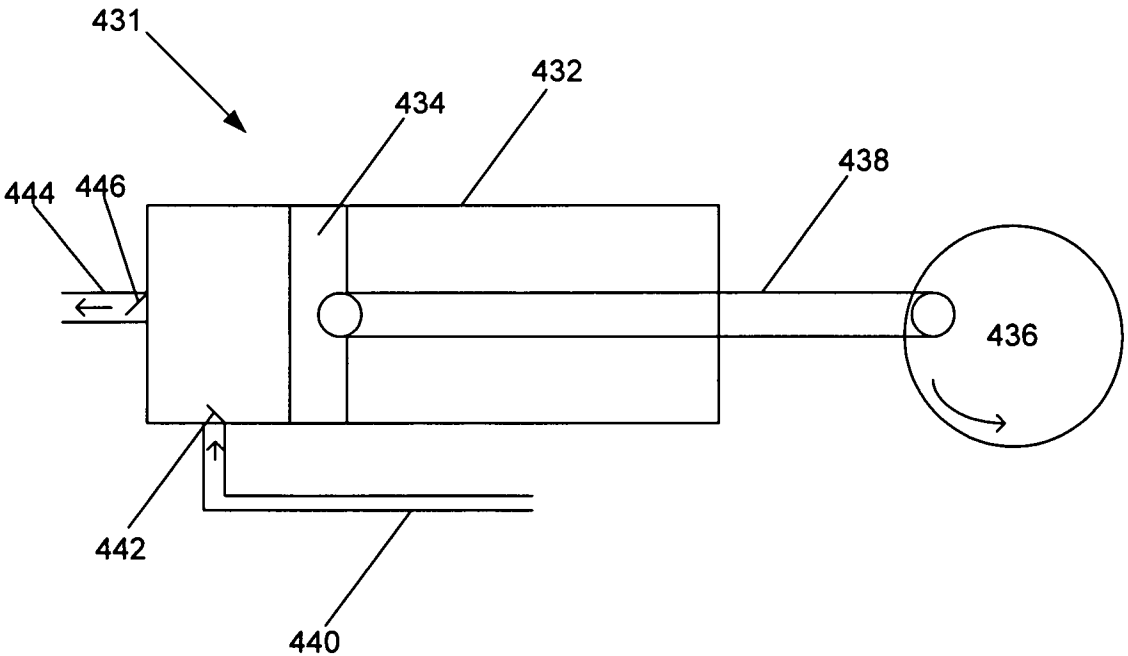
FIG. 3 illustrates a pulsing mechanism.

Referring now to FIG. 3, in some embodiments, there is illustrated pulsing mechanism 431. Pulsing mechanism 431 includes cylinder 432 within which is placed piston 434. Drive wheel 436 is connected to piston 434 by linkage 438. Linkage 438 is pivotally connected to piston 434 and drive wheel 436. As drive wheel 436 rotates, linkage 438 moves back and forth, which moves piston 434 back and forth. On the backstroke, piston 434 moves to the right and opens one-way valve 442 allowing fluid to enter through inlet 440. On the front stroke, one-way valve 442 is forced closed and one-way valve 446 is forced open, as fluid is forced into outlet 444. Drive wheel 436 may be rotated by an engine or motor, as desired.

Figure 4:
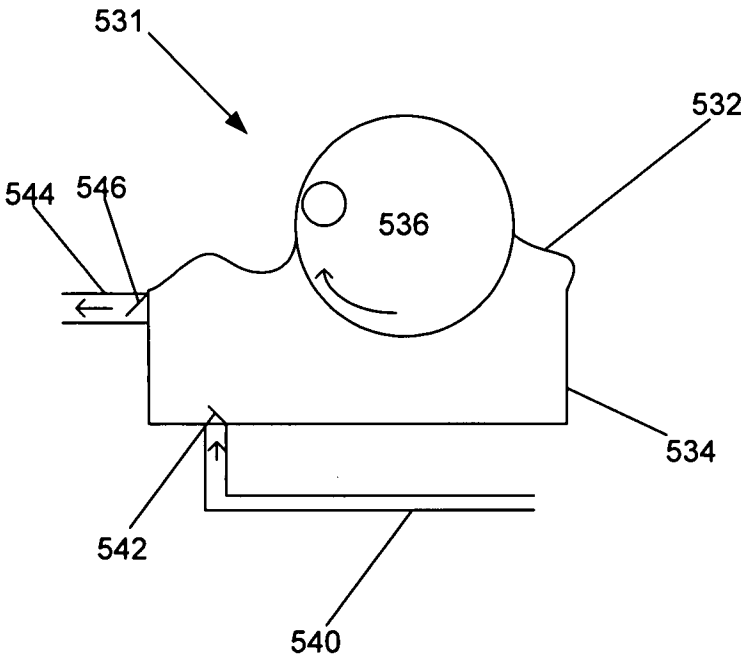
FIG. 4 illustrates a pulsing mechanism.

Referring now to FIG. 4, in some embodiments, pulsing mechanism 531 is illustrated. Pulsing mechanism 531 includes bladder 532 connected to support structure 534. Wheel 536 is eccentrically mounted to a pivot and rotates in the direction of the arrow. As wheel 536 rotates, it squeezes bladder to a smaller volume which forces open one-way valve 546 and forces fluid out of outlet 544. When wheel 536 continues to rotate, bladder is allowed to expand so that fluid can flow through inlet 540 and through one-way valve 542. Each time wheel 536 rotates, there is a full cycle of bladder having a smaller volume then a larger volume. Wheel 536 may be rotated by an engine or motor, as desired.

Figure 5:
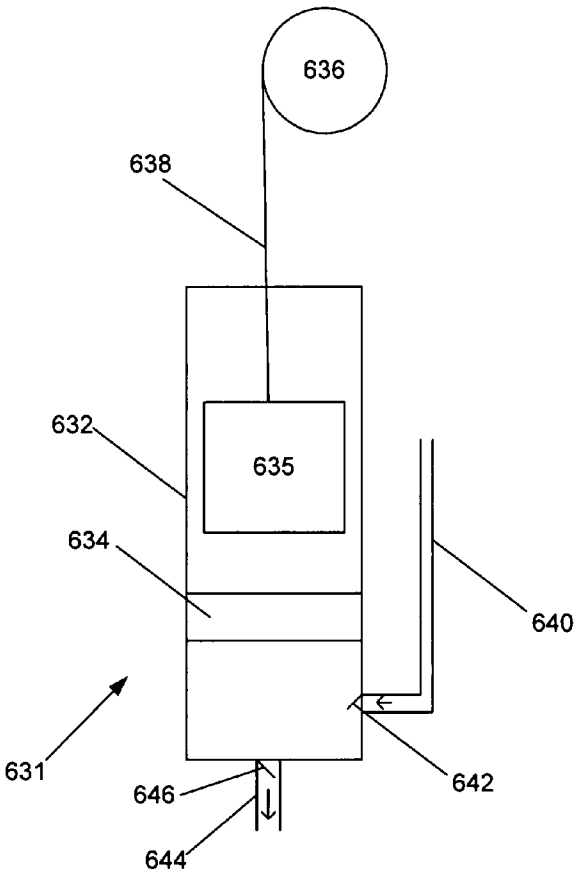
FIG. 5 illustrates a pulsing mechanism.

Referring now to FIG. 5, in some embodiments, pulsing mechanism 631 is illustrated. Mechanism 631 includes piston 634 within cylinder 632. Mass 635 is hanging from wire 638, which is wound about wheel 636. Mass 635 is repeatedly lifted by wire 638 by rotating wheel 636. Then wheel 636 is released and allowed to rotate, which allows mass 635 to fall and strike piston 634 forcing fluid out of cylinder 632 through valve 646 and into outlet 644. Mass 635 is repeatedly lifted and dropped until piston 634 bottoms out at the bottom of cylinder 632. At that point mass 635 is lifted, and fluid is forced through inlet 640 and through one-way valve 642 to raise piston 634 to a desired level, so that mass 635 can again be dropped to force fluid into outlet 644. Wheel 636 may be rotated with an engine or motor, as desired.

Figure 6:
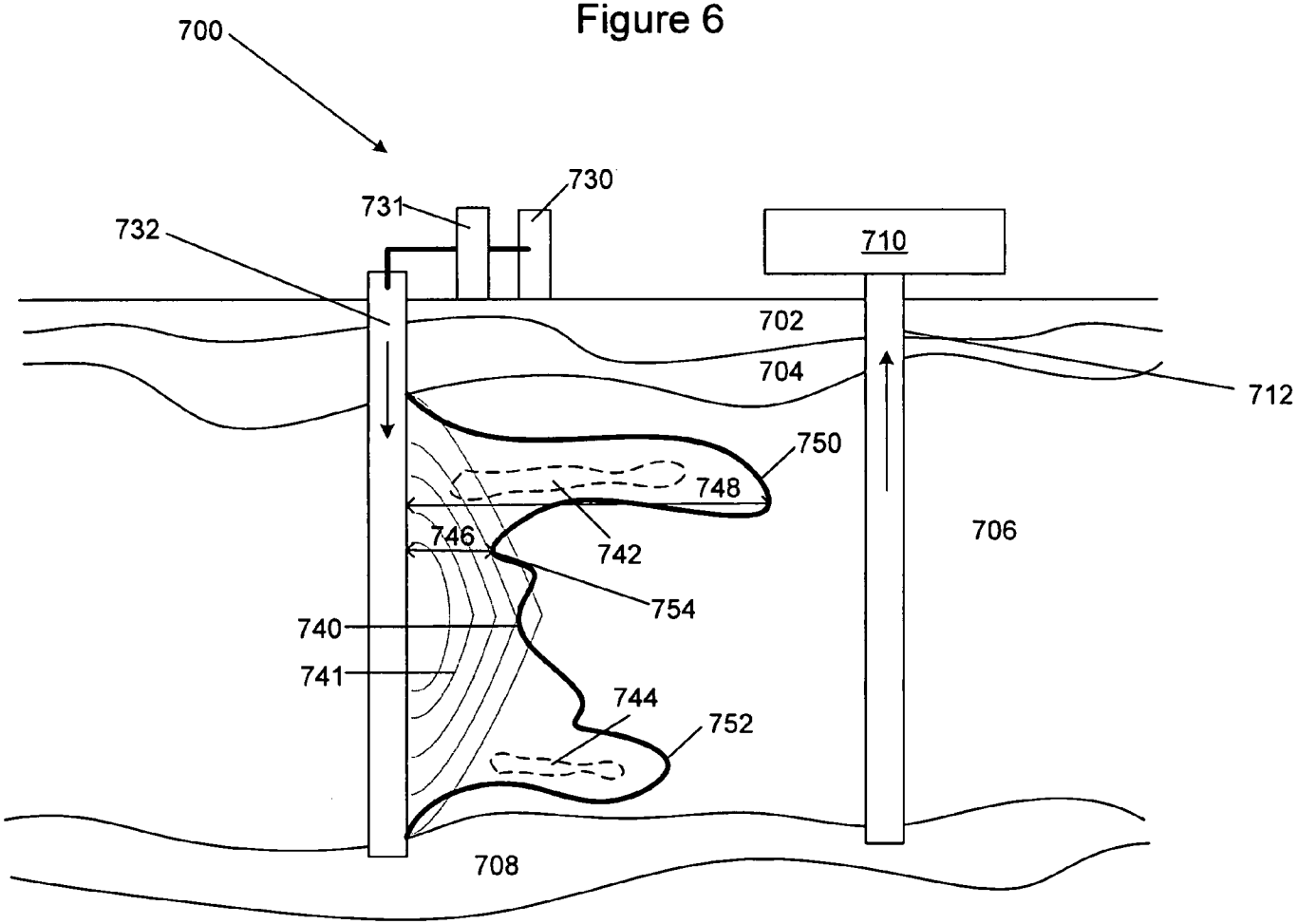
FIG. 6 illustrates an oil and/or gas production system.

Referring now to FIG. 6, in some embodiments of the invention, system 700 is illustrated. System 700 includes formation 702, formation 704, formation 706, and formation 708. Production facility 710 is provided at the surface. Well 712 traverses formation 702 and 704 has openings in formation 706. Portions of formation may be optionally fractured and/or perforated. As oil and gas is produced from formation 706 it enters well 712 and travels up to production facility 710. Production facility 710 may be able to produce carbon disulfide formulation, which may be produced and stored in carbon disulfide formulation storage 730. Hydrogen sulfide and/or other sulfur containing compounds from well 712 may be sent to carbon disulfide formulation production 730. Carbon disulfide formulation is pumped through pulsing mechanism 731 down well 732, to formation 706. Carbon disulfide formulation traverses formation 706 to aid in the production of oil and gas, and then the carbon disulfide formulation, oil and/or gas may all be produced to well 712, and to production facility 710. Carbon disulfide formulation may then be recycled, for example by boiling the carbon disulfide formulation, condensing it or filtering or reacting it, then re-injecting the carbon disulfide formulation into well 732.

Pulsing mechanism 731 creates pulse waves 741 which radiate out from well 732. Carbon disulfide formulation has progress profile 740, with fingers 750 and 752 due to fractures 742 and 744. Finger 750 has progressed a distance 748 towards well 712 due to fracture 742, while portion 754 of progress profile 740 has only progressed a distance 746. Fractures 742 and 744 are used to refer to fractures and/or other areas of relatively high porosity.

Pulse waves 741 strength weakens the further the waves travel from well 732. In the absence of pulsing mechanism 731, finger 750 would channel through to well 712 and the carbon disulfide formulation would bypass the majority of formation 706, and travel through finger 750 from well 732 to well 712. However, with pulsing mechanism 731, portion 754 receives a strong pulse since distance 746 is small, and finger 750 receives a weak pulse since distance 748 is large. This pulsing effect tends to minimize channeling and/or enhance the creation of a more uniform progress profile 740. Pulsing mechanism 731 may act as a self-correcting system to minimize fingering and/or create a more uniform front.

Figure 7:
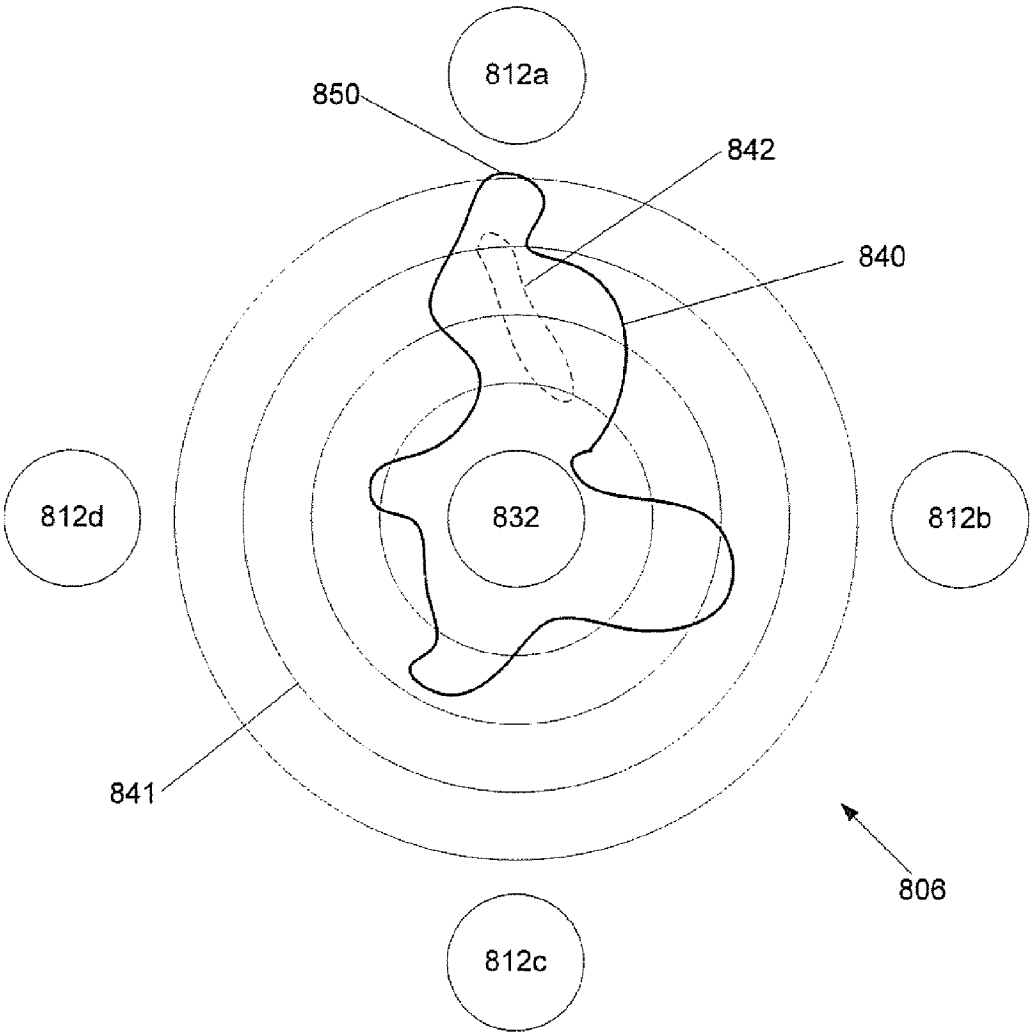
FIG. 7 illustrates an oil and/or gas production system.

Referring now to FIG. 7, a top view of formation 806 is illustrated. Injection well 832 is located at the center, and producing wells 812*a*, 812*b*, 812*c*, and 812*d* are around injection well 832. As a fluid is pulsed within an injection Well 832, pulse waves 841 are generated. Fluid has progressed to the line shown by fluid progress 840. Finger 850 was created because fluid quickly moved across fracture 842. Pulse waves 841 are weaker at the end of finger 850 than in other areas closer to injection well 832, which will tend to diminish the effects of channeling, and may tend to create a more uniform fluid progress profile 840. Once finger 850 reaches producing well 812*a*, producing well 812*a* may be shutoff and fluid progress 840 may continue towards producing wells 812*b*, 812*c*, and 812*d*.

In some embodiments, pulsing may be done at a frequency from about 1 pulse per minute to about 100 pulses per minute. In some embodiments, pulsing may be done at a frequency from about 5 pulses per minute to about 50 pulses per minute. In some embodiments, pulsing may be done at a frequency from about 10 pulses per minute to about 20 pulses per minute.

In some embodiments, pulsing a carbon disulfide formulation provides an improved recovery factor of original oil in place as compared to a constant pressure injection of a carbon disulfide formulation alone, or as compared to pulsing another enhanced oil recovery agent.

In some embodiments, suitable systems and methods for producing and/or using carbon disulfide formulations are disclosed in U.S. Pat. No. 7,426,959, filed Apr. 19, 2006, which is herein incorporated by reference in its entirety.

Illustrative Embodiments

In one embodiment of the invention, there is disclosed a system comprising a carbon disulfide formulation storage; a mechanism for releasing at least a portion of the carbon disulfide formulation into a formation; and a mechanism for creating a pulse in the carbon disulfide formulation in the formation. In some embodiments, the system also includes a mechanism for recovering at least one of a liquid and gas from the formation, the mechanism for recovering comprising a well in the underground formation and a recovery facility at a topside of the well. In some embodiments, the mechanism for releasing the carbon disulfide formulation comprises a well in the underground formation for releasing the carbon disulfide formulation into the formation. In some embodiments, the underground formation is beneath a body of water. In some embodiments, the system also includes a mechanism for injecting water, the mechanism adapted to inject water into the formation after carbon disulfide formulation has been released into the formation. In some embodiments, the mechanism for creating a pulse comprises a piston in a cylinder. In some embodiments, the mechanism for creating a pulse comprises a mechanism adapted to alternatively squeeze and then release a fluid bladder. In some embodiments, the mechanism for creating a pulse comprises a piston in a cylinder, and a mass adapted to be repeatedly dropped on the piston, to drive the piston in the cylinder. In some embodiments, the mechanism for releasing comprises an injection well, and wherein the mechanism for recovering comprises a plurality of production wells about the injection well. In some embodiments, at least one of the plurality of the production wells is adapted to be shut off when the carbon disulfide formulation from the injection well reaches that production well.

In one embodiment of the invention, there is disclosed a method comprising releasing a carbon disulfide formulation into a formation; and creating a pulse in the carbon disulfide formulation in the formation. In some embodiments, the method also includes recovering at least one of a liquid and a gas from the formation. In some embodiments, the method also includes recovering carbon disulfide formulation from the formation, and then releasing at least a portion of the recovered carbon disulfide formulation into the formation. In some embodiments, releasing comprises injecting at least a portion of the carbon disulfide formulation into the formation in a mixture with one or more of hydrocarbons; water in the form of liquid and/or vapor; sulfur compounds other than carbon disulfide; carbon dioxide; carbon monoxide; or mixtures thereof. In some embodiments, the method also includes heating the carbon disulfide formulation prior to releasing the carbon disulfide formulation into the formation, or while within the formation. In some embodiments, creating a pulse in the carbon disulfide formulation comprises creating a pulse having a frequency from 1 to 100 cycles per minute. In some embodiments, another material is released into the formation after the carbon disulfide formulation is released, for example the another material selected from the group consisting of air, water in the form of liquid and/or vapor, carbon dioxide, and/or mixtures thereof. In some embodiments, the carbon disulfide formulation is released at a pressure from 0 to 37,000 kilopascals above the initial reservoir pressure, measured prior to when carbon disulfide injection begins. In some embodiments, any oil, as present in the formation prior to the releasing the carbon disulfide formulation, has a viscosity from 0.14 cp to 6 million cp, for example a viscosity from 0.3 cp to 30,000 cp, or from 5 cp to 5,000 cp. In some embodiments, the formation comprises a permeability from 0.0001 to 15 Darcies, for example a permeability from 0.001 to 1 Darcy. In some embodiments, any oil, as present in the formation prior to the injecting the carbon disulfide formulation, has a sulfur content from 0.5% to 5%, for example from 1% to 3%. In some embodiments, the method also includes converting at least a portion of the recovered liquid and/or gas into a material selected from the group consisting of transportation fuels such as gasoline and diesel, heating fuel, lubricants, chemicals, and/or polymers.

Those of skill in the art will appreciate that many modifications and variations are possible in terms of the disclosed embodiments of the invention, configurations, materials and methods without departing from their spirit and scope. Accordingly, the scope of the claims appended hereafter and their functional equivalents should not be limited by particular embodiments described and illustrated herein, as these are merely exemplary in nature.

The invention claimed is:

1. A system for producing oil comprising:

a carbon disulfide formulation storage containing a carbon disulfide formulation;

a mechanism for releasing at least a portion of the carbon disulfide formulation into an underground oil-bearing formation comprised of a porous media comprising a solid matrix and an interconnected pore system within the matrix, the mechanism comprising a well in the formation for releasing the carbon disulfide formulation into the formation; and a mechanism for creating a pulse of fluid pressure in the carbon disulfide formulation in the formation, the mechanism comprising a piston and a cylinder to create the pulse, wherein the pulse has a frequency from 1 to 100 cycles per minute and wherein the mechanism creates the pulse of fluid pressure that minimizes channelling of the carbon disulfide formulation through the formation.

2. The system of claim 1, further comprising a mechanism for recovering at least one of a liquid or gas from the formation, the mechanism for recovering comprising the well in the underground formation and a recovery facility at a topside of the well.

3. The system of claim 1, wherein the underground formation is beneath a body of water.

4. The system of claim 1, further comprising a mechanism for injecting water, the mechanism adapted to inject water into the formation after carbon disulfide formulation has been released into the formation.

5. The system of claim 1, wherein the mechanism for creating a pulse comprises a mass adapted to be repeatedly dropped on the piston, to drive the piston in the cylinder.

6. The system of claim 1, wherein the mechanism for releasing comprises an injection well, and wherein the mechanism for recovering comprises a plurality of production wells about the injection well.

7. The system of claim 6, wherein at least one of the plurality of the production wells is adapted to be shut off when the carbon disulfide formulation from the injection well reaches that production well.

8. A method for producing oil comprising:

releasing a carbon disulfide formulation into an oil-bearing formation comprised of a porous media that is comprised of a solid matrix and an interconnected pore system within the matrix; and creating a pulse of fluid pressure in the carbon disulfide formulation in the formation, wherein the pulse of fluid pressure has a frequency from 1 to 100 cycles per minute and wherein the pulse of fluid pressure minimizes channelling of the carbon disulfide formulation through the formation.

9. The method of claim 8, further comprising recovering at least one of a liquid and a gas from the formation.

10. The method of claim 9, further comprising converting at least a portion of the recovered liquid or gas into a material selected from the group consisting of transportation fuels such as gasoline and diesel, heating fuel, lubricants, chemicals, or polymers.

11. The method of claim 8, further comprising recovering carbon disulfide formulation from the formation, and then releasing at least a portion of the recovered carbon disulfide formulation into the formation.

12. The method of claim 8, wherein releasing comprises injecting at least a portion of the carbon disulfide formulation into the formation in a mixture with one or more of hydrocarbons; water in the form of liquid or vapor; sulfur compounds other than carbon disulfide; carbon dioxide; carbon monoxide; or mixtures thereof.

13. The method of claim 8, further comprising heating the carbon disulfide formulation prior to releasing the carbon disulfide formulation into the formation, or while within the formation.

14. The method of claim 8, wherein another material is released into the formation after the carbon disulfide formulation is released, the another material selected from the group consisting of air, water in the form of liquid or vapor, carbon dioxide, and mixtures thereof.

15. The method of claim 8, wherein the carbon disulfide formulation is released at a pressure from 0 to 37,000 kilopascals above the initial reservoir pressure, measured prior to when carbon disulfide injection begins.

16. The method of claim 8, wherein any oil, as present in the formation prior to the releasing the carbon disulfide formulation, has a viscosity from 0.14 cp to 6 million cp.

17. The method of claim 8, wherein the formation comprises a permeability from 0.0001 to 15 Darcies.

18. The method of claim 8, wherein any oil, as present in the formation prior to the injecting the carbon disulfide formulation, has a sulfur content from 0.5% to 5%.

* * * * *